US005657905A

United States Patent [19]

Glynn

[11] Patent Number: 5,657,905

[45] Date of Patent: *Aug. 19, 1997

[54] CHILD RESISTANT SAFETY CAP WITH COLLAR AND SEMI-FLEXIBLE TETHER FOR SPRAYERS

[75] Inventor: Kenneth P. Glynn, Flemington, N.J.

[73] Assignee: Ideal Ideas, Inc., Flemington, N.J.

[ * ] Notice: The term of this patent shall not extend beyond the expiration date of Pat. No. 5,356,043.

[21] Appl. No.: 519,951

[22] Filed: Aug. 28, 1995

Related U.S. Application Data

[63] Continuation-in-part of Ser. No. 323,237, Oct. 14, 1994, Pat. No. 5,509,580, which is a continuation-in-part of Ser. No. 113,237, Aug. 30, 1993, Pat. No. 5,356,043.

[51] Int. Cl.[6] ..... B67B 5/00

[52] U.S. Cl. ..... 222/153.1; 222/182; 222/543; 215/216; 220/375

[58] Field of Search ..... 222/182, 153.1, 222/153.14, 546, 543; 215/216, 223; 220/375

[56] References Cited

U.S. PATENT DOCUMENTS

| | | | |
|---|---|---|---|
| 2,950,847 | 8/1960 | Tupper | 222/543 X |
| 3,170,603 | 2/1965 | Kitterman | 222/543 X |
| 3,703,974 | 11/1972 | Boxer et al. . | |
| 3,765,578 | 10/1973 | Stull | 222/546 |
| 3,782,578 | 1/1974 | Ballin . | |
| 3,848,780 | 11/1974 | Stull | 222/546 X |
| 4,002,275 | 1/1977 | Crowle et al. | 222/543 |
| 4,065,035 | 12/1977 | Eissler | 222/543 X |
| 4,095,718 | 6/1978 | Kong . | |
| 4,361,243 | 11/1982 | Virtanen . | |
| 4,746,035 | 5/1988 | Anderson et al. | 222/153.1 X |
| 5,092,493 | 3/1992 | Pehr | 215/216 X |
| 5,356,043 | 10/1994 | Glynn . | |
| 5,397,008 | 3/1995 | Glynn . | |
| 5,509,580 | 4/1996 | Glynn | 222/153.1 |

*Primary Examiner*—Kevin P. Shaver
*Attorney, Agent, or Firm*—Kenneth P. Glynn, Esq.

[57] ABSTRACT

The present invention is a spray dispenser device closure. It includes a main closure base for attachment to a container, an outer ring, a spray mechanism attached to the base, a semi-flexible tether, and an overcap. The main closure base has a top portion with a circular horizontal track thereon for attachment with an outer ring. The outer ring has a circular inside wall with a horizonal track thereon for attachment to the track of the base so as to connect them in such a way as to be horizontally and freely rotatable thereabout. The outer ring has a top with an outwardly or, alternatively, an inwardly biased ledge for retaining an overcap and has at least one cut out on the ledge to permit an overcap to be inserted and removed from the outer ring. The overcap has a circular bottom adapted to be inserted into or, alternatively, onto the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out. The semi-flexible tether has a rest position and a twisted position and has a first end connected to the outer ring and a second end connected to the overcap.

22 Claims, 3 Drawing Sheets

CHILD RESISTANT SAFETY CAP WITH COLLAR AND SEMI-FLEXIBLE TETHER FOR SPRAYERS

REFERENCE TO RELATED APPLICATION

This application is a Continuation-in-Part of U.S. Pat. application Ser. No. 08/323,237, filed on Oct. 14, 1994, U.S. Pat. No. 5,509,580 by the above inventor herein, entitled, "Child Resistant Cap for Sprayers," which is a Continuation-in-Part of U.S. Pat. application Ser. No. 08/113,237, filed on Aug. 30, 1993 by the above inventor herein, entitled, "Child Resistant Cap with Safety Collar for Sprayers," and which became issued U.S. Pat. No. 5,356,043 on Oct. 18, 1994.

BACKGROUND OF THE INVENTION

1. Field of the Invention

The present invention relates to child resistant caps, and more particularly to caps with semi-flexible tethered safety collars for sprayers. By sprayers is meant spray containers having atomizers, pumps, pressurized contents with release valves, and other spray dispensing mechanisms.

2. Information Disclosure Statement

Safety caps have been well known for at least three decades and literally come in many hundreds of shapes and forms with diverse mechanisms for achieving safety. The objective of such devices is to slow down or prevent the opening of a dispenser by a child to ultimately reduce or prevent use of a medication or dangerous or hazardous material by a young child who may unwittingly consume some of the contents and suffer severe consequences. The following patents represent four variations on safety caps which exemplify the art:

U.S. Pat. No. 3,703,974 to Leo Boxer and Robert Boxer describes a safety cap and container combination wherein the container mouth includes a plurality of spaced ribs or flanges, each having a differently located, notched out passageway over which a cap member having at least one projecting internal lug is positioned in a single movement to close the container. In one form of the invention, a bead at the rim of the container mouth may be provided to mate with an internal groove in the cap member to seal tightly the cap member to the container. In order to remove the cap member, it is moved partially away from the container to disengage the bead from the groove and the lug member is then positioned and aligned with each slot and advanced therethrough in successive fashion to open the mouth of the container.

U.S. Pat. No. 3,782,578 to Gene Ballin sets forth a novel disposable closure. The device includes an opener for opening a closure cap along a score line around the base of an annular channel without piercing the cap. It includes a collar which rotatably and slidably engages the cap and includes a peripheral wall provided with circumferentially spaced depending arcuate teeth of greater thickness than the channel and stop elements which limit the downward movement of the device on the cap. The device is pressed downwardly and rotated so that the teeth wedge between and spread the channel walls to sever the closure along the full length of the score line. The piercing of the channel by the teeth is prevented by the stop elements.

U.S. Pat. No. 4,095,718 to Cheung Tung Kong describes a convertible safety cap. A cap is provided for closing a container having a locking portion for use in a precautionary arrangement to prevent children from obtaining access into the container. The cap is convertible so as to cooperate with such a container to provide not only such a precautionary arrangement but also an alternative easy opening arrangement. The invention includes a cap, an annular disk and a locking rim with notches through which tabs on the cap may pass.

U.S. Pat. No. 4,361,243 to Risto Virtinen describes a closing means for a container, tube or the like. This device is a closing means for a nozzle which is fixably mounting on a container or for a tube or the like. The closing means is openable when turned into a predetermined position which is indicated by indicators provided on the closing means and on the container. It is settable diametrically opposite to each other, and characterized in that the lower rim of the closing means or the upper rim of the container is provided with a separate background ring extending at least partially behind the indicator of the closing means and the indicator of the container.

U.S. Pat. No. 5,356,043 to Kenneth P. Glynn describes a spray dispenser device closure. The device includes a main closure base for attachment to a container, an outer ring, a spray mechanism attached to the base and an overcap. The outer ring has a circular inside wall with a horizontal track for attachment to a track on the base and is connected in such a manner as to be freely and horizontally rotatable thereabout. The overcap has at least one protrusion which has a geometry of adequate size to freely move through cut outs on the ledge of the outer ring. The overcap, having a circular bottom, is inserted into the outer ring and over the spray mechanism. The closing means is openable only when the overcap and the outer ring are turned relative to one another and the alignment of protrusions and cut outs occurs.

U.S. Pat. No. 5,397,008 to Kenneth P. Glynn describes a container closure device. The device includes a container with a neck, an open top and a horizontal retainer track for affixing a collar ring and a cap upon the neck. The collar ring has a circular inside wall and a horizontal track and is freely rotatable about the retainer track. The collar ring has a ledge to frictionally engage the cap, and has at least one cut out to permit a cap to be inserted and removed from the collar ring. The cap has semi-flexible walls and has at least one protrusion which corresponds to and has adequate size to freely move through the cut outs of the collar ring. The closing means is openable only when the cap and collar ring are held separately and are rotated relative to one another and the alignment of the protrusions and cut outs occurs.

Notwithstanding the significant prior art in this field, it is believed that the present invention, which utilizes a safety collar (outer ring) in the particular fashion described herein, is neither taught nor rendered obvious.

SUMMARY OF THE INVENTION

The present invention is a spray dispenser device closure. It includes a main closure base for attachment to a container, an outer ring, a spray mechanism attached to the base, a semi-flexible tether, and an overcap. The main closure base has a top portion with a circular horizontal track thereon for attachment with an outer ring. The outer ring has a circular inside wall with a horizontal track thereon for attachment to the track of the base so as to connect them in such a way as to be freely horizontally rotatable thereabout, but otherwise permanently connected to one another. The outer ring has a top with an outwardly biased ledge for retaining an overcap and has at least one cut out on the ledge to permit an overcap to be inserted onto and removed from the outer ring. In an alternative embodiment, the outer ring may have a top with an inwardly biased ledge for retaining an overcap and at least one cut out on the ledge to permit an overcap to be inserted and removed from the outer ring. The spray mechanism is attached to the top of the base and extends therethrough for insertion into a container. The overcap has a circular bottom adapted to be inserted onto or, in the alternative, into the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided. The semi-flexible tether has a first end connected to the outer ring and a second end connected to the overcap. The tether has a rest position and a twisted position and it is connected to the outer ring and the overcap at locations such that when the tether is in its rest position, the at least one protrusion and the at least one cut out are not in alignment, and such that when the cap is rotated relative to the ring and the tether is in a twisted position, the at least one protrusion and the at least one cut out are in alignment to permit lift up removal of the overcap from the outer ring.

BRIEF DESCRIPTION OF TEE DRAWINGS

The present invention will be more fully understood when the specification herein is taken in conjunction with the drawings appended hereto, wherein.

DETAILED DESCRIPTION OF THE INVENTION

The present invention is a spray dispenser device closure. It includes a main closure base for attachment to a container, an outer ring, a spray mechanism attached to the base, a semi-flexible tether, and an overcap. The main closure base has a top portion with a circular horizontal track thereon for attachment with an outer ring. The outer ring has a circular inside wall with a horizontal track thereon for attachment to the track of the base so as to connect them in such a way as to be freely horizontally rotatable thereabout, but otherwise permanently connected to one another. The outer ring has a top with an outwardly biased ledge for retaining an overcap and has at least one cut out on the ledge to permit an overcap to be inserted onto and removed from the outer ring. Alternatively, the outer ring may have a top with an inwardly biased ledge for retaining an overcap and at least one cut out on the ledge to permit an overcap to be inserted and removed from the outer ring. The spray mechanism is attached to the top of the base and extends therethrough for insertion into a container. The overcap has a circular bottom adapted to be inserted onto or, in the alternative, into the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided. The semi-flexible tether has a first end connected to the outer ring and a second end connected to the overcap. The tether has a rest position and a twisted position and it is connected to the outer ring and the overcap at locations such that when the tether is in its rest position, the at least one protrusion and the at least one cut out are not in alignment, and such that when the cap is rotated relative to the ring and the tether is in a twisted position, the at least one protrusion and the at least one cut out are in alignment to permit lift up removal of the overcap from the outer ring.

Figure 1:
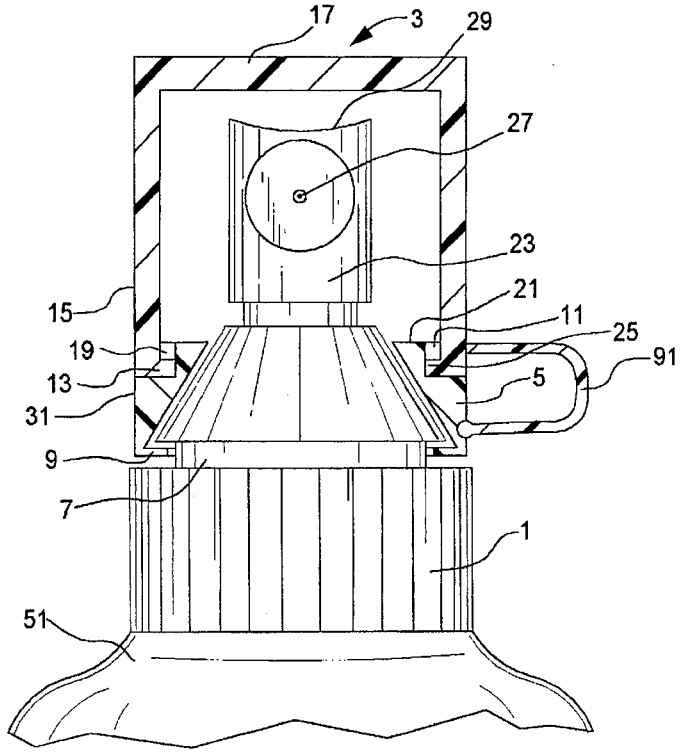
FIG. 1 shows a partial front partially cut view of an overcap, a semi-flexible tether, and an outer ring of a present invention spray dispenser device closure.

FIG. 1 shows a partial front partially cut, partial view of an overcap, a semi-flexible tether, and an outer ring of a present invention spray dispenser device closure. Here, main closure base 1 is shown attached to container 51. This is attached by known conventional means and may include crimping, heat sealing, force fitting, irreversible threading or any other known attachment means. Overcap 3 is shown in its cut view along with outer ring 5. Main closure base 1 includes a base track 7. In this case, it is a horizontal, circular indentation, as shown. Alternatively, it could be an annular protrusion or bead. Outer ring 5 has a track catch 9 which, in this case, is a protrusion which fits into base track 7 and allows outer ring 5 to be freely horizontally rotated about main closure base 1. As an alternative, if base track 7 were a bead protrusion, then outer ring track catch 9 would be an indentation instead of a protrusion. In other words, it is not critical as to whether the base or the outer ring has the male or female portion of the track. In any event, by "track" is meant either an indentation or a protrusion so that a complementary component rides the track. This is similar to tracks for a subway which may be protruding from the ground such as in the underground section or indented into the roadway such as above ground tracking.

The semi-flexible tether 91 is connected to both overcap 3 and outer ring 5 and acts not only as a tether, but also as an aligning mechanism. The tether 91 has a rest position and a twisted position. Overcap 3 and outer ring 5 are attached via the tether 91 such that when the tether 91 is in its rest (untwisted) position, the protrusion and cut out are not aligned, and when overcap 3 is rotated relative to outer ring 5 it may be rotated so that tether 91 is twisted and the protrusions and cut outs are aligned.

In order to remove overcap 3, outer ring 5 and overcap 3 must be rotated relative to one another so that the protrusions are aligned with the cut outs, as mentioned. This "firing" or opening position occurs when the tether 91 is twisted. When the user opens overcap 3 and lets overcap 3 go to hold the container in one hand and empty a pill or the like in the other hand, tether 91 returns to its rest position, moving the protrusions and cut outs into non-alignment. When overcap 3 is snapped back on, it is closed in the non-firing position. Thus, tether 91 is stiff enough to recover to its rest position to "align" overcap 3 and outer ring 5 into a non-firing position, i.e. align then so that protrusions and cut outs are not aligned. The tether 91 is attached at one end to sidewall 15 of overcap 3. It is formed in a horizontal U-shape as shown. Tether 91 has a snap-in bead for attachment to sidewall 31 of outer ring 5 as discussed with respect to FIGS. 8 and 9 below.

Figure 2:
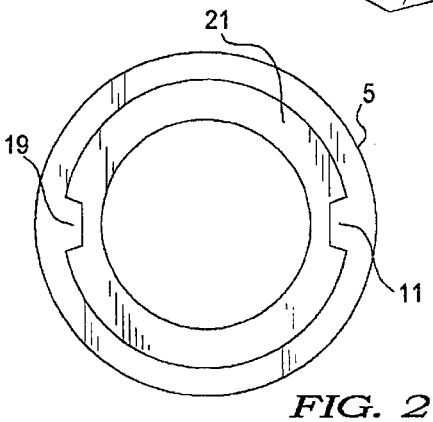
FIG. 2 shows a top view of an outer ring used in the closure shown in FIG. 1.

FIG. 2 shows a top view of outer ring 5.

Referring both to FIGS. 1 and 2, outer ring 5 has a ledge 21 with cut outs 11 and 19. Extending downwardly from ledge 21 and elaborated more with respect to FIG. 4 below, are elevational sections which maintain some friction between overcap 3 and outer ring 5. Thus, when a user rotates outer ring 5 without touching overcap 3, overcap 3 will travel with outer ring 5, so as to maintain non-alignment and eliminate chance of alignment for removal of overcap 3 from outer ring 5.

Figure 3:
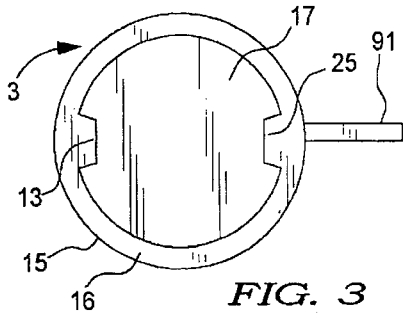
FIG. 3 shows a bottom view of the overcap and tether used in the closure shown in FIG. 1.

FIG. 3 shows a bottom view of overcap 3. Identical parts are identically numbered.

Referring now to FIGS. 1 and 3, overcap 3 has a top 17 and a side wall 15 which includes inwardly extending protrusions 13 and 25 at its bottom 16. These are of adequate geometry so as to be able to fit into and slide out of cut-outs 11 and 19 of ledge 21 of outer ring 5. These protrusions 13 and 25 are opposite one another and of the same geometry but could be different in geometry or not directly opposite one another as discussed with respect to FIG. 5, below. Also shown in FIG. 1 is a front view of spray mechanism 23 which includes spray nozzle tip 27 and a spray depressor 29. This is connected to main closure base 1 and extends downwardly therethrough so as to extend into container 51 (not shown) while spray mechanism 23 is shown to be a spray nozzle which may rely upon pressurized contents and depression for release thereof, it could very well be a pump, or other known spray mechanisms such as an atomizer.

In a more preferred embodiment, ledge 21 and/or protrusions 13 and 25 have adequate flexibility so that overcap 3 may be pressed downwardly and, with the flexion of either the protrusion or the ledge 21, or both, overcap 3 will snap into place so that the protrusions 13 and 25 end up under ledge 21 in a secure, child resistant fashion. The flexibility will be minimal such that overcap 3 cannot then be removed, except by alignment of protrusions 13 and 25 with the cut outs 11 and 19.

Figure 4:
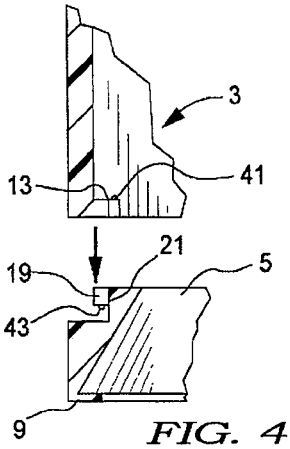
FIG. 4 shows a partial cut side view of a portion of an overcap and outer ring illustrating details of the closure shown in FIG. 1.

FIG. 4 shows a front cut, partial view of overcap 3 and outer ring 5 from FIG. 1. Identical parts are identically numbered. Protrusions 43, e.g., downwardly extending bumps or triangular cross-sectioned extensions, are located on the underside of ledge 21 and similar protrusions 41 are located on the top side of protrusion 13. These nest when overcap 3 is snapped onto outer ring 5 and enhance the friction between the overcap 3 and the outer ring 5. In fact, due to the friction between the overcap 3 and the outer ring 5, mentioned above, if either only the overcap 3 or only the outer ring 5 is rotated, the other will rotate with it and the non-alignment feature will be maintained. Thus, in preferred embodiments, a user can only remove overcap 3 by holding outer ring 5 with one hand and rotating overcap 3 with the other hand or vise versa so as to overcome the friction between the two and align the protrusions 13 and 25 with cut outs 11 and 19 for subsequent removal of the overcap 3 from the outer ring 5 to provide access to the spray mechanism 23.

Figure 5:
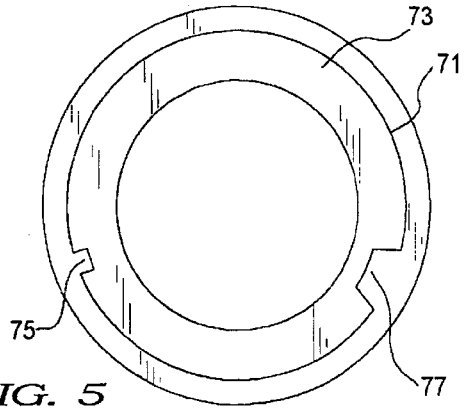
FIG. 5 shows a top view of an alternative embodiment outer ring for a present invention closure.

FIG. 5 shows a top view of an outer ring 71 which may be used in an alternative embodiment closure of the present invention. Here, ledge 73 has cut outs 75 and 77 which are not directly opposite one another and are of different sizes.

Figure 6:
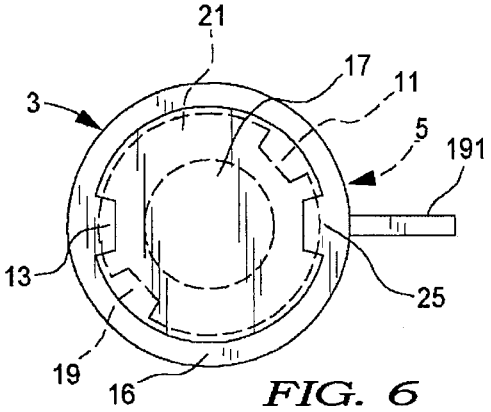
FIGS. 6 and 7 show top partial views of an overcap and outer ring in the tether rest position and the tether twisted position respectively.
Figure 7:
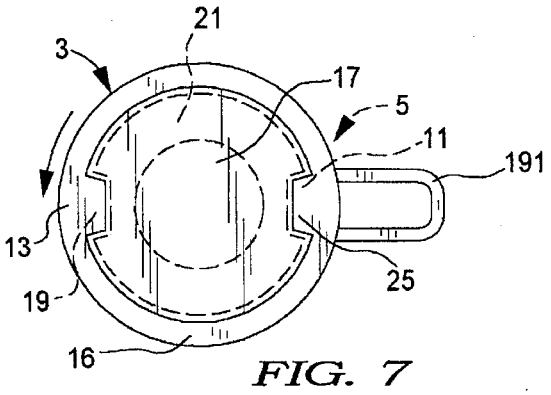

Referring to FIGS. 6 and 7, there is shown a bottom view of overcap 3 and a dotted line overlay of ledge 21, with tether 91 in its rest and twisted positions, respectively. All parts shown in the previous Figures are identically numbered. FIG. 6 shows tether 91 at rest and with protrusions 13 and 25 not aligned with cut outs 11 and 19 respectively. Thus, if overcap 3 were open, i.e. off outer ring 5, and tether 91 was in the rest position shown in FIG. 6, upon snapping overcap 3 to outer ring 5, the aforesaid non-alignment of protrusions and cut outs would be achieved.

If a user then held outer ring 5 with one hand and overcap 3 with the other hand and rotated overcap 3 as shown in FIG. 7 (i.e., rotated the protrusions and cut outs toward one another) to achieve alignment of the protrusions and cut outs, tether 91 would be twisted as shown in FIG. 7, and overcap 3 would be fired, i.e. opened. The user would release overcap 3, while open, to take contents from a container to which outer ring 5 would be attached, and tether 91 would spring back to its rest position, rotating overcap 3 into a non-firing position (non-alignment of protrusions and cut outs) to assure a child resistant, safe closing every time.

Figure 8:
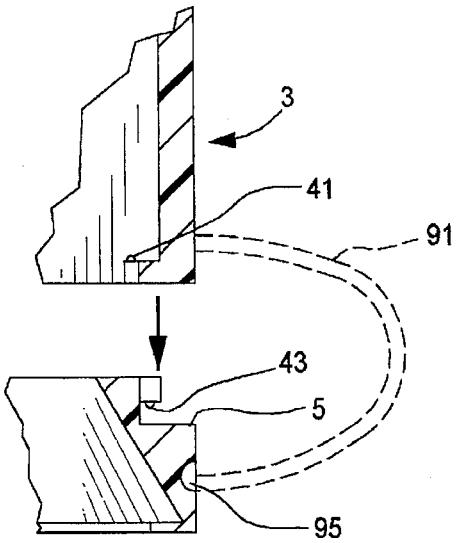
FIGS. 8 and 9 show partial cut side views of a portion of an overcap and outer ring illustrating details of the closure and tether shown in FIG. 1.
Figure 9:
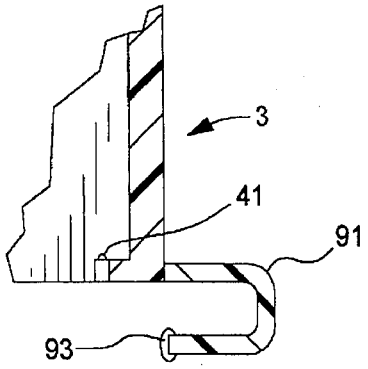

Referring to FIGS. 8 and 9, there is shown a front cut, partial view of overcap 3 and outer ring 5 from FIG. 1. Identical parts are identically numbered. Tether 91 has a snap-in bead 93 which may be permanently engaged into opening 95 of outer ring 5. Because snap-in bead 93 may be rounded and opening 95 may likewise be rounded, bead 93, once snapped into opening 95, may rotate within opening 95 so as to act like a hinge pin. This is easily seen in FIG. 1 where tether 91 would have some rotational play relative to side wall 31 of outer ring 5. Tether 91 also prevents complete 360° rotation of overcap 3 relative to outer ring 5, and a rotation of, for example, 15° to 40° from non-firing to firing positions, may be preferred. Thus, by virtue of the embodiment shown in FIGS. 1 through 9, the present invention device will be child resistant and will also be friendly to people with dexterity difficulties, such as senior citizens, due to the ease with which the frictional engagement of the overcap and outer ring may be overcome for subsequent removal of the overcap.

The above embodiment shows the overcap as being inserted onto the outer ring by being snapped onto the outside of the outer ring. Conversely, the overcap could be snapped into the inside of the outer ring (i.e., the outer ring comprising an inwardly biased ledge for retaining an overcap) without exceeding the scope of the present invention and one such embodiment is discussed below.

Figure 10:
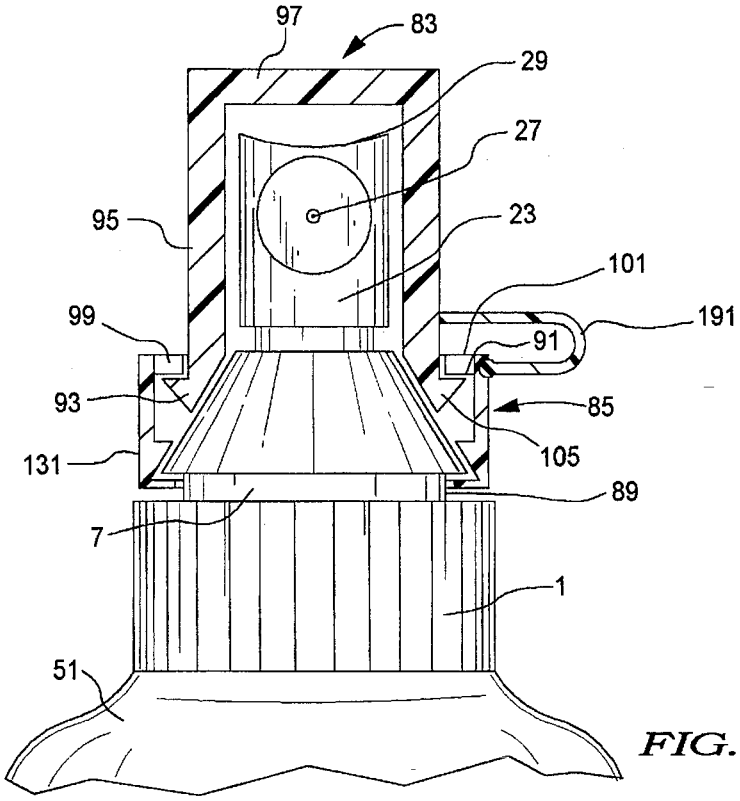
FIG. 10 shows a partial front partially cut view of an alternative embodiment overcap, semi-flexible tether, and outer ring of a present invention spray dispenser device closure; and, FIG. 11 shows a partial cut view of a present invention device utilizing an alternative mechanism for hinging the tether.

Referring now to FIG. 10, there is shown a partial front partially cut view of an alternative embodiment present invention spray dispenser device closure which includes overcap 83, tether 191, and outer ring 85. Identical parts are identically numbered. Main closure base 1, which includes base track 7, is shown attached to container 51. Spray mechanism 23 which includes spray nozzle 27 and spray depressor 29 is also shown. Overcap 83 is shown in its cut view along with outer ring 85. Overcap 83 includes a top 97 and a sidewall 95 which includes outwardly extending protrusions 93 and 105 at its bottom. These are of adequate geometry so as to be able to fit into and slide out of cut outs 91 and 99 of ledge 101 of outer ring 85, similar to the arrangement in FIG. 1 but somewhat reversed. Tether 191 is connected to sidewall 95 of overcap 83 and extends to connect to sidewall 131 of outer ring 85. Thus, a user will separately hold outer ring 85 and overcap 85 and rotate them relative to one another to align protrusions 93 and 105 with cut outs 91 and 99 for lift up removal of overcap 83. The functional operation is generally the same as described above with respect to FIG. 1.

Figure 11:
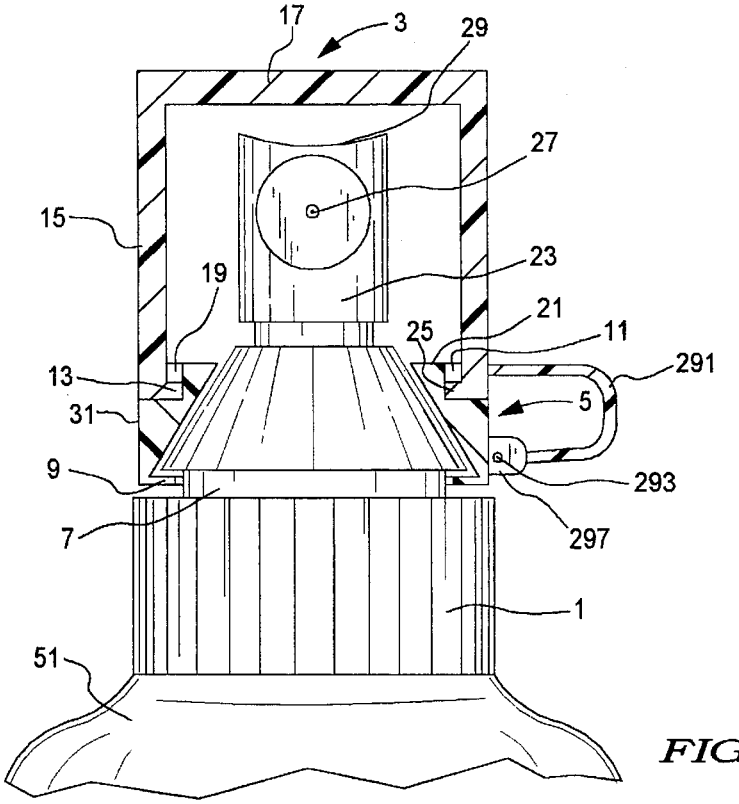

FIG. 11 shows a variation of the device shown in FIG. 1 with identical parts identically numbered except that tether 291 has unistructurally formed hinge pins such as pin 293 which are inserted into a pair of female hinge plates such as hinge plate 297. Much like bead 93 and its rotational ability within opening 95, the pins such as pin 293 and the hinge plate such as hinge plate 297 allow for rotation of the tether so that overcap 3 may be removed by twisting and lifting, as described above, and, further due to the hinge rotatability, may be rotated totally away from the spray mechanism 23. Thus, the embodiment shown in FIG. 11, and other perceived embodiments, may be used with various containers.

Obviously, numerous modifications and variations of the present invention are possible in light of the above teachings. It is therefore understood that within the scope of the appended claims, the invention may be practiced otherwise than as specifically described herein.

What is claimed is:

1. A spray dispenser device closure, which comprises:

(a) a main closure base for attachment to a container, said base having a top portion having a circular horizontal track thereon for attachment with an outer ring;

(b) an outer ring having a circular inside wall with a horizontal track thereon for attachment to the track of said base so as to connect said outer ring to said base so as to be horizontally and freely rotatable thereabout, said outer ring also having a top with a ledge for retaining an overcap, and having at least one cut out on said ledge to permit an overcap to be inserted onto and removed from said outer ring;

(c) a spray mechanism attached to the top of said base and extending therethrough for insertion into a container;

(d) an overcap having a circular bottom adapted to be inserted into said outer ring and over said spray mechanism, said bottom having at least one protrusion thereon which has a geometry of adequate size to freely move through said at least one cut out of said ledge of said outer ring and when said overcap is so inserted and rotated, of adequate size and geometry to prevent removal of said overcap from said outer ring, except when said at least one protrusion and said at least one cut out are in alignment; and, further wherein said outer ring ledge has an underside and said at least one protrusion of said overcap has a top wherein the underside of said ledge and the top side of said at least one protrusion are in frictional contact with one another when said overcap is inserted into said outer ring such that when one of said outer ring and said overcap are rotated, the other of said outer ring and said overcap rotates therewith, and wherein said frictional contact may be overcome manually by holding one of said outer ring and said overcap and rotating the other of said outer ring and said overcap; and, (e) a semi-flexible tether having a first end connected to said outer ring and having a second end connected to said overcap; said tether having a rest position and a twisted position, said tether being connected to said outer ring and said overcap at locations such that when said tether is in its rest position, said at least one protrusion and said at least one cut out are not in alignment, and such that when said overcap is rotated relative to said outer ring and said tether is in a twisted position, said at least one cut out and said at least one protrusion are in alignment to permit lift up removal of said overcap from said outer ring.

2. The device of claim 1 wherein said ledge of said outer ring is biased outwardly relative to an inside wall of said circular bottom of said overcap and wherein said at least one protrusion of said overcap is biased inwardly relative to said ledge of said outer ring, and wherein said overcap fits on the outside of said outer ring and fits over said spray mechanism.

3. The device of claim 1 wherein said ledge of said outer ring is biased inwardly relative to an inside wall of said circular bottom of said overcap and wherein said at least one protrusion of said overcap is biased outwardly relative to said ledge of said outer ring, and wherein said overcap fits on the inside of said outer ring and fits over said spray mechanism.

4. The spray dispenser device closure of claim 1 wherein said main closure base has means for attachment to a container.

5. The spray dispenser device closure of claim 4 wherein said means for attachment is threading.

6. The spray dispenser device closure of claim 1 wherein said at least one cut out comprises two cut outs.

7. The spray dispenser device closure of claim 6 wherein said cut outs are directly opposite one another.

8. The spray dispenser device closure of claim 6 wherein said cut outs are not directly opposite one another.

9. The spray dispenser device closure of claim 1 wherein said underside of said ledge and said top of said at least one protrusion have non-smooth topographies to enhance said frictional contact.

10. The spray dispenser device closure of claim 1 wherein at least one of said ledge and said protrusions is downwardly flexible so as to permit insertion of said overcap without alignment of said at least one protrusion and said at least one cut out, and is upwardly inflexible so as to prevent removal of said overcap from said outer ring, except when said at least one protrusion and said at least one cut out are in alignment.

11. The spray dispenser device closure of claim 10 wherein said main closure base has means for attachment to a container.

12. The spray dispenser device closure of claim 11 wherein said means for attachment is threading.

13. The spray dispenser device closure of claim 10 wherein at least one cut-out comprises two cut-outs.

14. The spray dispenser device closure of claim 13 wherein said cut-outs are directly opposite one another.

15. The spray dispenser device closure of claim 13 wherein said cut-outs are not directly opposite one another.

16. The spray dispenser device closure of claim 10 wherein said underside of said ledge and said top of said at least one protrusion have non-smooth topographies to enhance said frictional contact.

17. The spray dispenser device closure of claim 1 wherein said tether is integrally formed with at least one of said overcap and said outer ring.

18. The spray dispenser device closure of claim 1 wherein said tether is integrally formed with both of said overcap and said outer ring.

19. The spray dispenser device closure of claim 1 wherein one of said outer ring and said overcap has a hinge component attachable to said tether and said tether is attached to said overcap and said outer ring and wherein said tether has attachment means for attachment to said hinge component.

20. The spray dispenser device closure of claim 10 wherein said tether is integrally formed with at least one of said overcap and said outer ring.

21. The spray dispenser device closure of claim 10 wherein said tether is integrally formed with both of said overcap and said outer ring.

22. The spray dispenser device closure of claim 10 wherein one of said outer ring and said overcap has a hinge component attachable to said tether and said tether is attached to said overcap and said outer ring and wherein said tether has attachment means for attachment to said hinge component.

* * * * *